United States Patent [19]

Hasegawa

[11] 4,008,639

[45] Feb. 22, 1977

[54] DEVICE FOR SEVERING A VENEER SHEET

[75] Inventor: Katsuji Hasegawa, Nagoya, Japan

[73] Assignee: Meinan Machinery Works, Inc., Ohbu, Japan

[22] Filed: Jan. 26, 1976

[21] Appl. No.: 652,304

Related U.S. Application Data

[62] Division of Ser. No. 546,605, Feb. 3, 1975.

[52] U.S. Cl. ..... 83/371; 83/13; 83/372; 83/401; 83/422; 83/436

[51] Int. Cl.[2] ..... B26D 5/38

[58] Field of Search ..... 83/359, 360, 364, 365, 83/367, 369, 370, 371, 372, 401, 422, 436, 509, 607, 608

[56] References Cited

UNITED STATES PATENTS

| | | | |
|---|---|---|---|
| 3,477,327 | 11/1969 | Aizawa | 83/371 |
| 3,741,054 | 6/1973 | Alperin et al. | 83/360 |
| 3,760,667 | 9/1973 | Maxey et al. | 83/371 |
| 3,844,207 | 10/1974 | Townsend | 83/4 |

FOREIGN PATENTS OR APPLICATIONS

| | | | |
|---|---|---|---|
| 1,325,699 | 8/1973 | United Kingdom | 83/371 |

*Primary Examiner*—Donald R. Schran
*Attorney, Agent, or Firm*—Woodhams, Blanchard and Flynn

[57] ABSTRACT

A device for severing a veneer sheet comprising a veneer sheet feeding means, a cutter member pivotally disposed on the feed-out side of said veneer sheet feeding means and having an edge portion adapted to work on the side of the fed-in veneer sheet during the pivotal movement of the cutter member, a means for sensing an irregularity or a predetermined length of said veneer sheet, a means for transmitting a signal in accordance with the sensing of the irregularity or the predetermined length of the veneer sheet and an actuator for actuating in response to said signal said cutter member to cut the veneer sheet in cooperation with a force by which the veneer sheet is fed. With such a device, severing can be done without stopping feeding of a veneer sheet and the arrangement of said cutter member dividing of a feed-out passage of the veneer sheet into two different directions.

16 Claims, 13 Drawing Figures

DEVICE FOR SEVERING A VENEER SHEET

This is a division, of application Ser. No. 546,605, filed Feb. 3, 1975.

FIELD OF THE INVENTION

The present invention relates to a device for severing a veneer sheet without stopping feeding of said veneer sheet.

More particularly, the present invention relates to a device for severing a veneer sheet without stopping feeding of said veneer sheet, in which there is effectively utilized, for severing the veneer sheet, a force by which said veneer sheet is fed, thus speeding up the whole operation, obviating labor of separating scraps from veneer sheets of acceptable quality and facilitating performance of the severing operation systematically in combination with other operations which are involved in the manufacture of plywood such as cutting of a veneer sheet off of a log, stacking of severed veneer sheets, etc.

BACKGROUND OF THE INVENTION

In conventional methods and devices, severing of such flat materials as veneer sheets is done by vertically shuttling a cutter member while the feed of a veneer sheet to be cut is temporarily stopped. Such conventional methods of and devices severing a veneer sheet are not suitable for continuously operating the preparation of a veneer sheet from a log and severing the veneer sheet in combination, since the cutting operation of a veneer sheet off of a log is in general carried out continuously without stopping. Illustratively stated, in the conventional methods and devices the feed of the veneer sheet should be temporarily stopped at the time of severing. While, the veneer sheet is, in general, continuously fed to the severing stage from the preceding stage of preparation of a veneer sheet from a log. Such continuous operation i.e. preparation of a veneer sheet from a log, can not be combined with the other intermittent operation, i.e. severing of the veneer sheet. Consequently, with the conventional severing methods and device, it is impossible to conduct the whole process for production of sized veneer sheets from a log in a systematic, continuous manner.

Another drawback of the conventional severing device is that after the severing operation severed veneer sheets are all fed out to the same place. Therefore, when the device is used for the purpose of removing inferior quality portions detected in a veneer sheet, removed scraps and the veneer sheet of acceptable quality are fed out to the same place and therefore, the work of separation of them is additionally required. Meanwhile, when a veneer sheet is severed into a group of sized veneer sheets of the same length and stacking the thus severed veneer sheets in good trim, the sized veneer sheets need to be fed each by each at a certain interval. In order to automatically obtain such necessary interval of sized veneer sheet-feeding in a conventional method, it is inevitably necessary to prolong a time for cutting or feeding a veneer sheet to be severed, leading to decrease in productivity.

A further drawback of the conventional severing device is that not only the cutter member but also parts connected to it are driven by a power source so that sufficient severing force is warranted during the severing operation. As a result, there is required a driving means of high power to shuttle the cutter member.

It is therefore an object of the present invention to provide a device for severing a veneer sheet which enables a severing operation without stopping the feed of a veneer sheet for improving efficiency in the manufacture of plywood.

Another object of the present invention is to provide a device as described wherein severed veneer sheets are fed alternately into two different directions.

A further object of the present invention is to provide a device of the character described, wherein a high power drive means for the cutter member is not necessary.

A still futher object of the present invention is to provide a device of the kind described, which is simple in construction and can be manufactured at a reasonable cost.

In the present invention, there is provided a device for severing a veneer sheet comprising a veneer sheet feeding means continuously driven and including a pair of members adapted to hold a veneer sheet therebetween, a cutter member pivotally disposed on the feed-out side of the veneer sheet feeding means and having an edge portion adapted to work on the side of the fed-in veneer sheet, a means for sensing an irregularity or a predetermined length of said veneer sheet, a means for transmitting a signal in accordance with the sensing of the irregularity or the predetermined length of the veneer sheet and an actuator for actuating in response to said signal the cutter member to pivot and cut the veneer sheet in cooperation with a force by which the veneer sheet is fed, the severed veneer sheets being adapted to be fed out in two different directions respectively of the upside and downside of the cutter member.

These and other objects, features and advantages of the invention may be readily understood from the following detailed description and appended claims taken in connection with the accompanying drawings.

DETAILED DESCRIPTION

Figure 1:
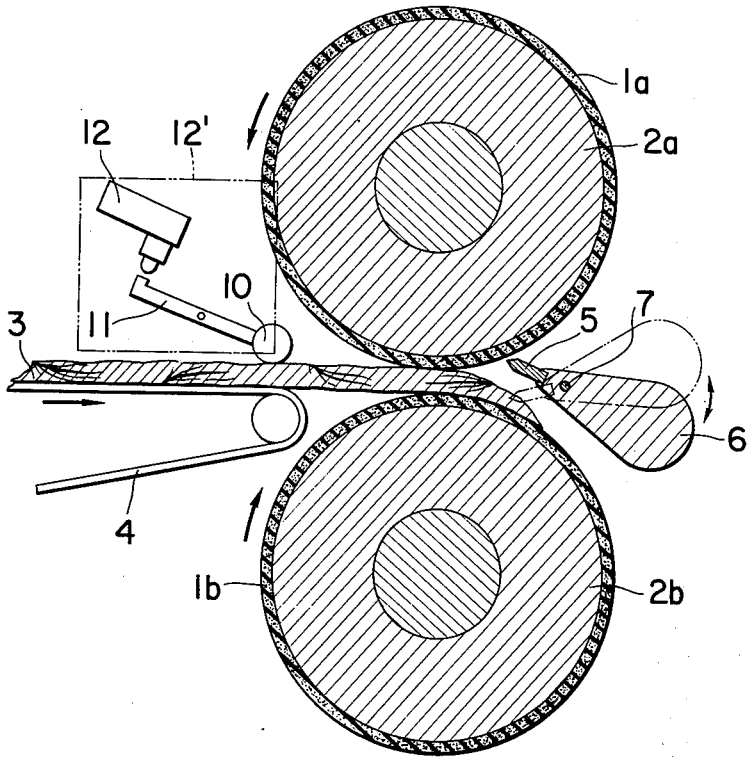
FIG. 1 is a sectional side view of a veneer sheet severing device embodying the present invention.

Referring now to FIG. 1 there is shown a device for severing a veneer sheet including steel or rubber rolls 2*a* and 2*b* with cylinders 1*a* and 1*b* of a resilient material respectively fitted therearound. Practically, omission of such cylinders does not cause so fatal defect, but the cylinders 1*a* and 1*b* may preferably be provided for surely protecting an edge portion of the cutter member.

The rolls 2*a* and 2*b* are disposed leaving a space for holding and feeding a veneer sheet 3 therebetween and driven in the arrow-marked direction by a motor (not shown).

The rolls 2*a* and 2*b* mentioned in the foregoing may be replaced by a pair of steel or rubber belts.

A conveyer belt 4 is provided on the feed-in side of the rolls so that the veneer sheet 3 is conveyed to near the rolls. A cutter member comprising an edge portion 5 and a body portion 6 is pivotally disposed on the feed-out side of the rolls 2*a* and 2*b*. The cutter member is adapted to pivot on a pin 7 in response to a signal from a signal transmitting means through an actuator (which will be mentioned later) to cut the veneer sheet 3 in each of the pivotal movements of the cutter member which are made alternately in the clockwise and counterclockwise directions.

Figure 5:
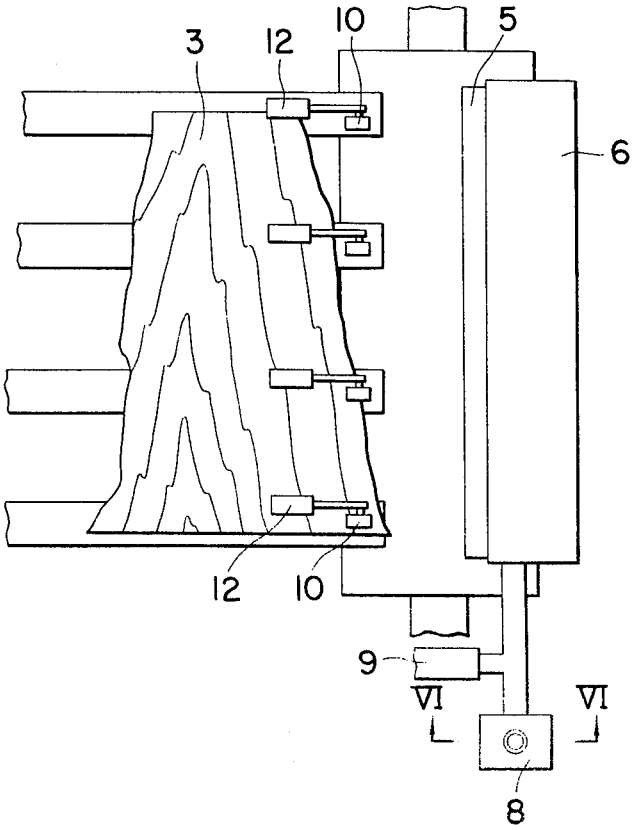
FIG. 5 is a plan view of the veneer sheet severing device in FIG. 1, with the upper member of feeding means taken away and with a rotary actuator added.

Referring to FIGS. 1 and 5, in the device of this invention there is provided a sensing means 12′ for sensing an irregularity in thickness of the veneer sheet 3. In accordance with an operation of said sensing means, the signal transmitting means transmits, with a time delay, a signal for actuating the cutter member. The sensing means 12′ comprises a plurality of units, each including a roller 10 and a limit switch comprising a movable contact 11 and a fixed contact 12. The roller 10 is rotatably supported on one end of the movable contact 11. The movable contact 11 is pivotally supported on a pin so that when the roller 10 is lifted, the other end of the movable contact 11 goes out of contact with the fixed contact 12 and when the roller 10 is lowered, the other end of the movable contact 11 comes into contact with the fixed contact 12.

Said plurality of units are so disposed that they are positioned over the whole breadth of the veneer sheet and the row of them is substantially at a right angle with a feed line of the fed veneer sheet as depicted in FIG. 5.

Numeral 8 designates a rotary actuator which is employed, in this embodiment, as an actuator for actuating the cutter member and which is fixedly connected to one end of the pivot pin 7 of the cutter member. The other end of the pivot pin 7 is rotatably supported by a suitable means (not shown). In respect of this actuator, the detailed explanation will be given later.

Figure 9:
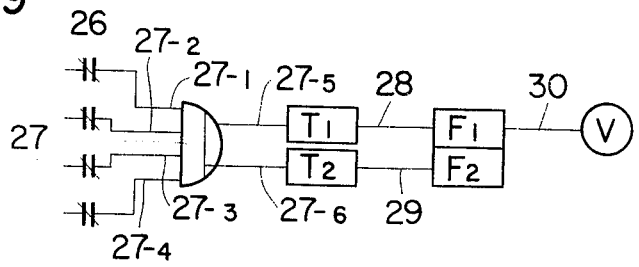
FIG. 9 is an electric circuit diagram showing a wiring between limit switches and the electromagnetic valve.
Figure 10:
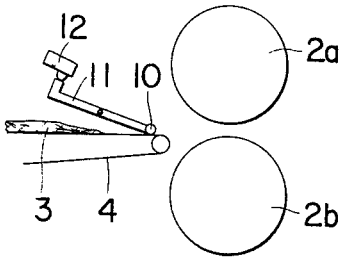
FIGS. 10 and 11 are diagrammatic views illustrating how a sensing means operates in association with the feeding of a veneer sheet.
Figure 11:
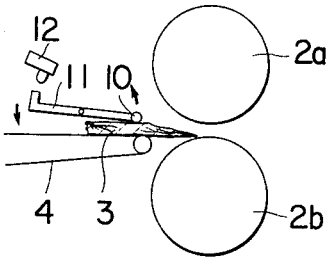

Referring to FIGS. 9, 10 and 11, the signal transmitting means comprising an OR circuit 27, timers $T_1$ and $T_2$ and a memory device comprising an ON signal receiving means $F_1$ and an OFF signal receiving means $F_2$, sends a signal, when actuated by closing or opening, due to an irregularity of the veneer sheet in thickness which is sensed by the sensing means, of the limit switches 26 electrically connected to the OR circuit 27, to an electromagnetic valve V. In response to the signal the electromagnetic valve V is energized or deenergized to actuate the cutter member shown in FIG. 1. Each of the limit switches 26 in FIG. 9 comprises the movable contact 11 and the fixed contact 12 shown in FIG. 1. When the veneer sheet 3 is not under the roller 10 yet as shown in FIG. 10 or when the veneer sheet 3 under the roller 10 is not so thick as a predetermined value, at least one of the limit switches 26 is closed, in other words, the movable contact 11 and the fixed contact 12 of the limit switch come into contact with each other, and, as a result, the signal transmitting means transmits a signal, with a time delay, for actuating the cutter member to pivot in the clockwise direction. Next, when the veneer sheet 3 having an acceptable thickness comes under the roll 10 as shown in FIG. 11, all of the limit switches 26 are opened, in other words, the movable contacts 11 and the fixed contacts 12 of the limit switches 26 go out of contact with each other and, as a result, the signal transmitting means transmits a signal, with a time delay for actuating the cutter member to pivot in the counterclockwise direction. The timers $T_1$ and $T_2$ are provided in the signal transmitting means for giving a time delay between the sensing of an irregularity and the actuation of the cutter member to adjust the timing of severing the veneer sheet 3 to an arrival thereof within the cutting zone since there is some distance between the positions of the sensing means 12′ and the cutter member. It is noted that the sensing means 12′ may comprise a plurality of units, each including a photoelectric tube for sensing an irregularity in breadth of the veneer sheet if uniform thickness is not necessarily required in sized veneer sheets as long as an exact rectangular shape is obtained.

Figure 6:
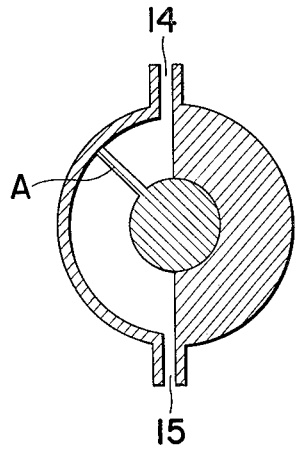
FIG. 6 is a cross sectional view of the rotary actuator taken along the line VI — VI of FIG. 5.

Referring to FIG. 6, there is illustrated the structure of the rotary actuator employed as an actuator in this embodiment. Numerals 14 and 15 designate ports through which air flows into the rotary actuator. Character A designates a vane which is fixedly connected to one end of the pin 7 of the cutter member and is pivotable by an inflow of air.

Figure 7:
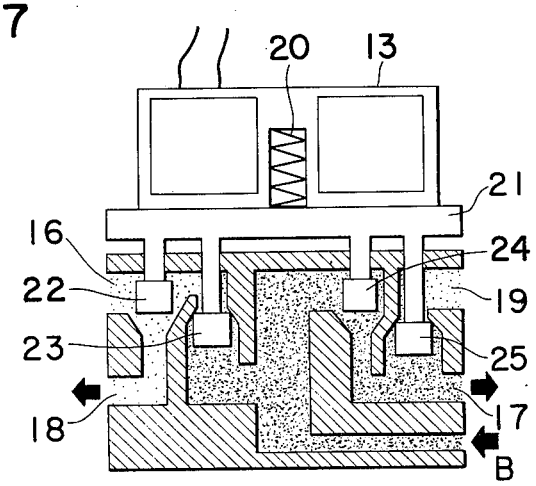
FIG. 7 is a sectional view of an electromagnetic valve for operating the rotary actuator, illustrating the position of a movable iron element when energized, with an electromagnet or solenoid shown in a diagrammatic view.
Figure 8:
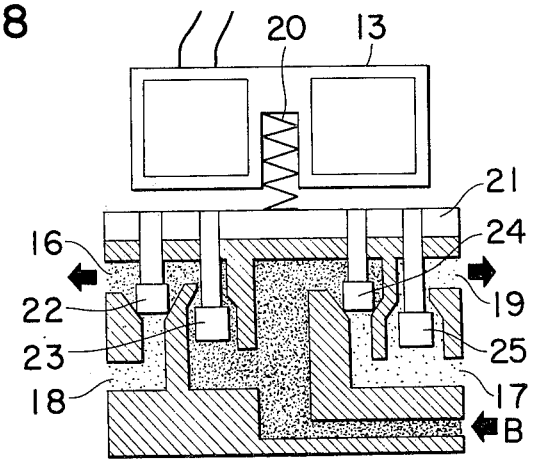
FIG. 8 is a sectional view similar to FIG. 7 illustrating the position of the movable iron element when deenergized.

Referring to FIGS. 7 and 8, there is illustrated the electromagnetic valve V which is employed for operating the rotary actuator 8. The electromagnetic valve comprises an electromagnet or solenoid 13, a valve body, and a movable element 21 made of a magnetic material. In the valve body, there are outlets 16 and 17, exhausts 18 and 19. The movable element 21 having valves 22, 23, 24 and 25 are disposed as depicted. The electromagnet 13 is adapted to be energized by receiving the signal from the signal transmitting means. The movable element moves up and down by the action of the electromagnetic force exerted by the electromagnet 13 and the action of a compression spring 20, respectively. According to the movement of the movable element 21, the valves 22, 23, 24 and 25 effectively function to make the compressed air flow into the rotary actuator through the ports 14 and 15 alternately. As a result, the rotary actuator 8 can be actuated in response to the signal from the signal transmitting means.

In operation, if the veneer sheet 3 is not yet under the rollers 10, all of the limit switches 26 each comprising the movable contact 11 and the fixed contact 12 are kept on as illustrated in FIG. 10. When all the limit switches 26 are closed, the OR circuit 27 in the signal transmitting means emits an ON signal at a feed-out side 27-5 to the timer $T_1$ where transferring of the ON signal to the memory device is delayed. The thus delayed signal goes into the ON signal receiving means $F_1$ of the memory device which is provided to render the signal transmitting means continue to transmit the signal unless the OFF signal receiving means $F_2$ of the memory device receives an OFF signal which will be explained later and then the signal is transmitted from the signal transmitting means. The thus transmitted signal is received by the electromagnetic valve V. (See, FIG. 9)

The moment the electromagnetic valve V receives the signal from the signal transmitting means, the electromagnetic valve V is energized as shown in FIG. 7, wherein the electromagnet 13 is magnetized and attracts the movable iron element 21. At this instant, the valves 22 and 24 are opened while the valves 23 and 25 are closed.

This electromagnetic valve is continuously supplied at a constant rate with the compressed air B from outside into the arrow-marked direction as shown in FIGS. 7 and 8. The compressed air B fed from outside is flown to the outlet 17 which communicates to the port 15 of the rotary actuator shown in FIG. 6.

By the inflow of the compressed air B into the actuator through the port 15 thereof, the vane A fixed to the pin 7 of the cutter member is pivoted in the clockwise direction and, at the same time, the cutter member is pivoted correspondingly. The pivotal movement of the cutter member is stopped by a stop 9 shown in FIG. 5 and accordingly, the vane A is stopped at a position as shown in FIG. 6. The position of the cutter member at this very moment is exactly as shown by full lines in FIG. 1.

The emission of the ON signal at the feed-out side 27-5 lasts as long as at least one of the limit switches 26 is kept on due to poor thickness of the veneer sheet from side to side even if the veneer sheet is already under the rollers 10 since the OR circuit 27 will not emit a signal at the feed-out side 27-6 unless all the switches are turned off.

Then, when the veneer sheet having an acceptable thickness from side to side comes under the rollers 10, all the rollers 10 are lifted, turning off all the limit switches 26 whereby an OFF signal is emitted at the feed-out side 27-6 of the OR circuit 27.

However, it is not until the thus emitted OFF signal reaches the OFF signal receiving means $F_2$ of the memory device with a time delay worked out in the timer $T_2$ for the purpose of adjusting the timing of energization of the electromagnetic valve V to the arrival of the veneer sheet having an acceptable thickness from side to side within the cutting zone that the ON signal kept transmitted ceases to be transmitted and the electromagnetic valve V gets deenergized.

Figure 2:
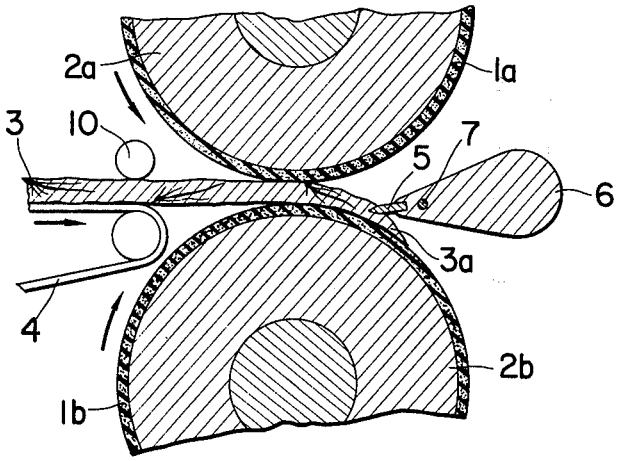
FIG. 2 is a view similar to FIG. 1, illustrating the state in which the cutter member starts to cut a veneer sheet.
Figure 3:
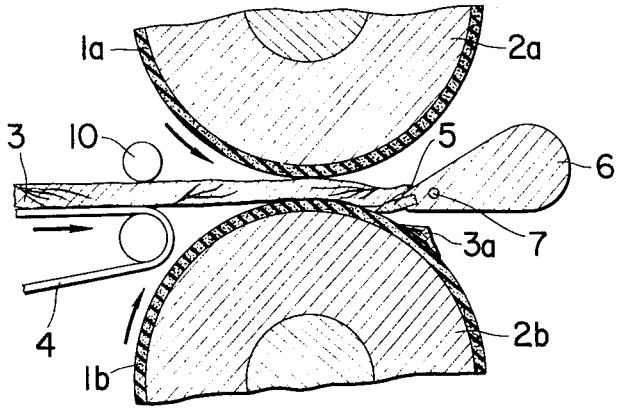
FIG. 3 is a view similar to FIG. 1 and FIG. 2, illustrating the state in which the cutter member completes cutting off of an inferior portion of the veneer sheet.
Figure 4:
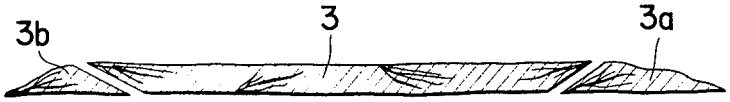
FIG. 4 is a sectional side view of the veneer sheet with the inferior portions cut off according to a method of this invention.

When the electromagnetic valve gets deenergized the movable element 21 is pushed away from the electromagnet by a compression spring 20. As a result, the valve 22 and 24 are closed while the valves 23 and 25 are opened and then, the compressed air B fed from outside is flown to the outlet 16 which communicates to the port 14 of the rotary actuator 8. By the inflow of the compressed air B into the actuator through the port 14 thereof, the vane A connected to the pin 7 of the cutter member is pivoted in the counterclockwise direction. This pivotal movement is transmitted to the cutter member, which pivots in the counterclockwise direction and the cutter member starts to sever the veneer sheet as shown in FIG. 2 for removing a inferior quality portion 3a off of the veneer sheet 3 as shown in FIG. 3, in cooperation with the force by which the veneer sheet 3 is fed. Illustratively stated, while the veneer sheet proceeds toward the edge portion of the cutter member, said edge portion pivots from the upper side to the lower side of the veneer sheet, thereby to effectively accomplish cutting.

In this way, the severing operation proceeds until the cutter member contacts the periphery of the roll 2b and the pivotal movement of the cutter member is stopped by the stop 9 provided for the purpose of maintaining the edge portion 5 on the side of the fed-in veneer sheet as well as preventing the edge portion 5 from being broken on contact with the roll **2*b*. The moment the edge portion 5 contacts the periphery of the roll 2b, the severing of the veneer sheet 3 is completed and the inferior quality portion 3*a* cut off of the veneer sheet 3 is automatically separated from the veneer sheet of acceptable quality, goes through a passage formed between the cutter member and the lower roll 2*b* and is discarded as a scrap. On the other hand, the veneer sheet from which the inferior quality portion 3*a* is removed goes through the passage formed between the cutter member and the upper roll 2*a*** and is fed along the upper side of the cutter member without being stopped.

Further, the moment another inferior quality portion 3b comes into the reach of the cutter member, the cutter member positioned as shown by a broken line in FIG. 1 starts to pivot in a clockwise direction in response to a signal transmitted from the signal transmitting means in such a way as described and the cutter member starts to sever the veneer sheet in cooperation with the force by which the veneer sheet is fed and the severing operation proceeds until the cutter member contacts the periphery of the roll 2a and the pivotal movement of the cutter member is stopped by the stop 9.

In this way, the severing operation is performed.

Another embodiment of the present invention is useful in severing a single veneer sheet which does not contain the inferior quality portions into two groups of veneer sheets, each sheet having the same length.

Figure 12:
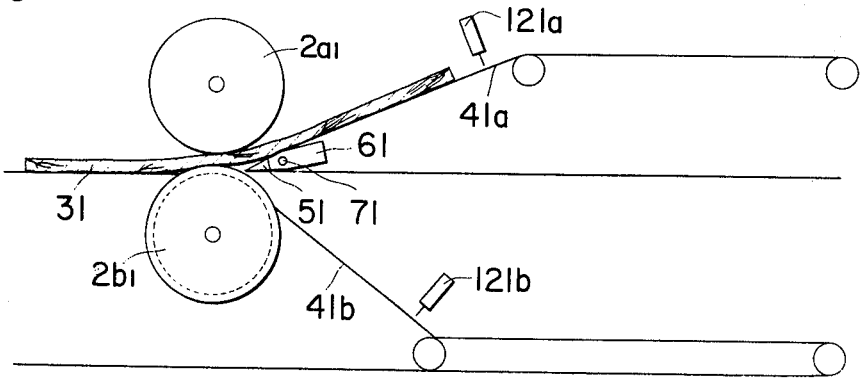
FIG. 12 is a diagrammatic view showing another embodiment of the present invention.

Referring to FIG. 12 there is shown a device for severing a veneer sheet including steel or rubber rolls $2a_1$ and $2b_1$ which are disposed leaving a space for holding and feeding a veneer sheet 31 therebetween and driven by a motor (not shown) so that the roll $2a_1$ rotates in the counterclockwise direction while the roll $2b_1$ in the clockwise direction. A cutter member comprising an edge portion 51 and a body portion 61 is pivotally disposed on the feed-out side of the rolls $2a_1$ and $2b_1$. The cutter member is adapted to pivot on a pin 71 in response to a signal from a signal transmitting means (not shown) through an actuator (not shown) to sever the fed veneer sheet 31 in each of the pivotal movements of the cutter member which are made alternately in the clockwise and counterclockwise directions. Said signal transmitting means transmits a signal in accordance with an operation of a means for sensing a predetermined length of the veneer sheet. Sensing means, for example limit switches **121*a* and 121*b* are disposed as such respectively on two different passages on the feed-out side of the rolls $2a_1$ and $2b_1$ with a predetermined distance from the cutter member. The sensing means 121***a* and 121*b* energize the signal transmitting means which transmits a signal in such a way that when the sensing means 121*a* senses a forward end of the fed veneer sheet 31, the cutter member pivots in the counterclockwise direction.

Figure 13:
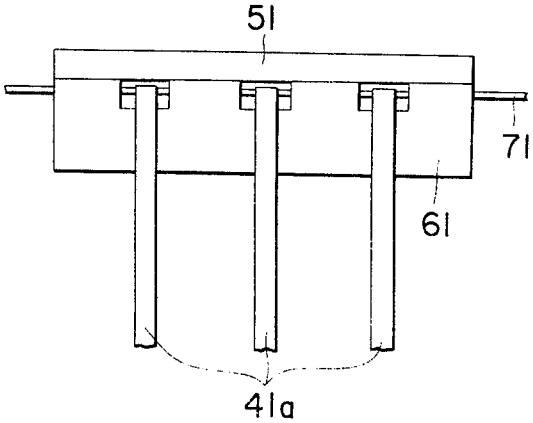
FIG. 13 is an enlarged plan view showing the state of combination of the cutter member and a severed veneer sheet conveyer means employed in FIG. 12.

Conveyer belts 41*a* for feeding the veneer sheet 31 out into one of two different directions pass over the pin 71 and are arranged with a spacing between each other as shown in FIG. 13.

Conveyer belts 41*b* for feeding the veneer sheet 31 out into the other of the two different directions pass over the grooves formed, with a spacing therebetween, around the periphery of the roll $2b_1$ as shown by a dotted line in FIG. 12.

In operation, when a cutter member comprising the edge portion 51 and the body portion 61 is positioned in such a way that the cutter member points to the lower roll $2b_1$, the single veneer sheet 31 goes through a passage formed between the upper roll $2a_1$ and the cutter member and proceeds along the upper surface of the cutter member and the conveyer belt 41*a*.

The moment the forward end of the fed veneer sheet 31 reaches the sensing means 121*a*, the sensing means or limit switch 121*a* is operated to energize the signal transmitting means to transmit a signal. In response to the signal the actuator actuates the cutter member to pivot in the clockwise direction and the cutter member severs the veneer sheet 31 to obtain a veneer sheet having a predetermined length. After the severing, the continuously fed veneer sheet 31 changes its course along the lower surface of the cutter member and is carried on the conveyer belts 41*b* while the sized veneer sheet having a predetermined length is fed into one of two different directions along the conveyer belts 41*a*.

The moment of the new forward end of the veneer sheet 31 which is carried on the conveyer belt 41*b* reaches the sensing means 121*b*, the sensing means 121*b* is operated to energize the signal transmitting means to transmit a signal. In response to the signal the actuator actuates the cutter member to pivot in the counterclockwose direction and the cutter member severs the veneer sheet to obtain another sized veneer sheet having a predetermined length. After the severing, the continuously fed veneer sheet 31 changes again its course along the upper surface of the cutter member and is carried on the conveyer belts 41*a* while the sized veneer sheet having a predetermined length is fed into the other one of the two different directions along the conveyer belts 41*b*.

The sized veneer sheets, after the above mentioned severings are done, are fed alternately to two different places for stacking or for drying if required.

It is also possible to use the instant embodiment in order to prepare veneer sheets having a predetermined length from those having different lengths. For example, a plurality of veneer sheets having inferior portions already removed but having various lengths are fed successively into the instant device and subjected to severing operation to obtain a train of veneer sheets which train has a predetermined length. When such train of veneer sheets are sliced, there can be easily obtained two groups of veneer sheets having predetermined lengths.

According to modification of the first embodiment, there can be obtained a veneer sheet having a predetermined length from a plurality of veneer sheets having different lengths and fed at different intervals therebetween. In practising, however, there is needed, in place of an ordinary sensing means, a specific type sensing means, for example, comprising in combination a photoelectric tube and an integrating meter. Such specific type sensing means is disposed on the feed-in side of the veneer sheet feeding means. A plurality of veneer sheets having various lengths are fed at various intervals. As the veneer sheets are fed, the sensing means senses the veneer sheets and integrates the lengths of the veneer sheets having passed. When the integrated lengths of veneer sheets come to a predetermined value, the sensing means operates the signal transmitting means to transmit a signal, with a time delay for adjusting timing of actuation of the cutter member as mentioned before. In response to the signal, the actuator actuates the cutter member. As a result, there are obtained groups of veneer sheets with the terminal veneer sheets cut. Each group of veneer sheets are spliced to obtain a veneer sheet having a predetermined length. As to the sensing means, a combination of a roller and a switch may, instead of a photoelectric tube, be used.

As deserbed, according to this invention, the difficulties and shortcomings described in the description of the prior art are obviated. More specifically, the severing operation can be performed without stopping feeding of veneer sheet and the feeding force is effectively used for severing the veneer sheets. As a result, the increased productivity is obtained. Even if a preceding operation such as a continuous preparation of veneer sheets from a log and the severing operation are planned to be performed in combination, the veneer sheet is not subject to unfavorable back pressure due to continuous feeding of the veneer sheet prepared from a log since the severing operation is performed also continuously.

Furthermore, when the method and the device according to the present invention are used for removing inferior quality portions from a veneer sheet, cut-off scraps and veneer sheets of acceptable quality can be separated on the spot. In other words, they are fed into two different directions after the severing is done. On the other hand, when a veneer sheet which does not contain inferior quality portions is to be severed into two groups of sized veneer sheets of the same length, severed veneer sheets are fed alternately along two different passages, at certain intervals between veneer sheets fed into each direction. Such feeding-out at an interval makes it possible to perform the severing operation and a subsequent operation in combination. For instance, if the severed veneer sheets are to be stacked at a yard etc., they are required to be fed there each by each with sufficient intervals in order to smoothly carry out the stacking operation. In any conventional method and device, it is impossible to obtain such sufficient intervals without decreasing productivity. By contrast, intervals as large as the length of a severed veneer sheet are obtained by the method and the device according to the present invention as easily understood from the description and FIG. 12.

Furthermore, in the present invention, since the veneer sheet feeding force is effectively utilized for severing, it is not necessary for the cutter member to be driven by a large force, leading to considerable reduction of mass of the cutter member as well as saving of power for the cutter member. As a result, the severing machine can be made compact as compared with the conventional one.

Thus, the work of severing veneer sheets is speeded up, labor of separating inferior quality portions from veneer sheets of acceptable quality is obviated. Moreover, the severing operation can be performed systematically with other operations involved in the manufacture of plywood such as cutting of a veneer sheet off of a log, stacking of severed veneer sheets, etc.

As described, with the method and the device of the present invention, the manufacture of plywood can be done with ease and high productivity.

What is claimed is:

1. A device for severing a veneer sheet comprising a veneer sheet feeding means continuously driven and including a pair of roller members adapted to hold a veneer sheet therebetween, a cutter member pivotally disposed on the feed-out side of the veneer sheet feeding means and having an edge portion adapted to work on the side of the fed-in veneer sheet, a means for sensing a preselected condition of said veneer sheet, a means for transmitting a signal in accordance with the sensing of the preselected condition of the veneer sheet, and an actuator for actuating in response to said signal the cutter member to pivot and cut the veneer sheet in cooperation with a force by which the veneer sheet is fed, the severed veneer sheets being adapted to be fed out in two different directions which are located on opposite sides of the cutter member.

2. A device according to claim 1, wherein the preselected condition sensed by said sensing means comprises one of the dimensions of the sheet.

3. A device according to claim 1, wherein said cutter member is disposed directly adjacent the nip between the pair of roller members adjacent the feed-out side thereof, said cutter member being pivotal between first and second positions about a pivot axis which extends substantially parallel to the rotational axis of the roller members and is disposed substantially in alignment with the feedout side of the nip, said cutter member having an axially elongated cutting blade which projects radially outwardly from the pivot axis toward the nip so that the cutting blade is thus substantially aligned with the feeding direction of the sheet when the cutter member is disposed in an intermediate position located between said first and second positions, said cutting blade being disposed more closely adjacent the periphery of one of the roller members when the cutter member is in said first position, and said cutting blade being disposed more closely adjacent the periphery of the other roller member when the cutter member is in said second position, whereby the cutting blade causes severing of the sheet as it is swingably displaced from the first position into said second position, and whereby the cutting blade also causes severing of the sheet when swingably displaced from said second position toward said first position.

4. A device for severing a veneer sheet comprising a veneer sheet feeding means continuously driven and including a pair of roller members adapted to hold a veneer sheet therebetween, a cutter member pivotally disposed on the feed-out side of the veneer sheet feeding means and having an edge portion adapted to work on the side of the fed-in veneer sheet, a means for sensing an irregularity of said veneer sheet, a means for transmitting a signal in accordance with the sensing of the irregularity of the veneer sheet, and an actuator for actuating in response to said signal the cutter member to pivot and cut the veneer sheet in cooperation with a force by which the veneer sheet is fed, the severed veneer sheets being adapted to be fed out in two different directions respectively of the upside and downside of the cutter member.

5. A device according to claim 4, wherein said sensing means is disposed on the feed-in side of said veneer sheet feeding means.

6. A device according to claim 4, wherein said sensing means comprises a plurality of units, each including a roller and a limit switch comprising a movable contact and a fixed contact, said roller being rotatably supported on one end of the movable contact.

7. A device according to claim 6, wherein said plurality of units are positioned over the whole breadth of the veneer sheet and the row of said units is substantially at a right angle with a feed line of the fed veneer sheet.

8. A device according to claim 5, wherein the signal transmitting means comprises an OR circuit, a pair of timers and a memory device, said OR circuit being electrically connected to said limit switches in said sensing means, whereby the timing of actuation of said actuator is adjusted.

9. A device according to claim 4, wherein said actuator is a rotary actuator comprising a casing and a vane pivotally disposed therein and fixedly connected to a pivot pin of the cutter member and operated by an electromagnetic valve adapted to supply compressed air into the rotary actuator alternately through two ports thereof.

10. A device according to claim 4, wherein said sensing means comprises a plurality of units, each including a photoelectric tube.

11. A device for severing a veneer sheet comprising a veneer sheet feeding means continuously driven and including a pair of roller members adapted to hold a veneer sheet therebetween, a cutter member pivotally disposed on the feed-out side of the veneer sheet feeding means and having an edge portion adapted to work on the side of the fed-in veneer sheet, a means for sensing a predetermined length of said veneer sheet, a means for transmitting a signal in accordance with the sensing of the predetermined length of said veneer sheet, and an actuator for actuating in response to said signal the cutter member to pivot and cut the veneer sheet in cooperation with a force by which the veneer sheet is fed, the severed veneer sheets being adapted to be fed out in two different directions respectively of the upside and downside of the cutter member.

12. A device according to claim 11, wherein said sensing means is disposed on each of the two different passages, on the feed-out side of the veneer sheet feeding means.

13. A device according to claim 11, wherein said sensing means comprises a limit switch.

14. A device according to claim 11, wherein said sensing means is disposed on the feed-in side of said veneer sheet feeding means.

15. A device according to claim 14, wherein said sensing means comprises a limit switch or a photoelectric tube and an integrating meter.

16. A device according to claim 14, wherein said sensing means comprises a roller, a limit switch and an integrating meter.

* * * * *